US005394823A

United States Patent [19]

Lenze

[11] Patent Number: 5,394,823

[45] Date of Patent: Mar. 7, 1995

[54] PIPELINE WITH THREADED PIPES AND A SLEEVE CONNECTING THE SAME

[75] Inventor: Friedrich Lenze, Ratingen, Germany

[73] Assignee: Mannesmann Aktiengesellschaft, Dusseldorf, Germany

[21] Appl. No.: 173,751

[22] Filed: Dec. 23, 1993

[30] Foreign Application Priority Data

Dec. 28, 1992 [DE] Germany ..... 42 44 587.6

[51] Int. Cl.[6] ..... E21B 43/00

[52] U.S. Cl. ..... 166/105; 166/65.1; 285/119; 285/355

[58] Field of Search ..... 285/119, 137.1, 355; 174/47, 136; 166/241.7, 241.6, 65.1, 385, 105

[56] References Cited

U.S. PATENT DOCUMENTS

| | | | |
|---|---|---|---|
| 2,001,172 | 5/1935 | Wintroath | 103/87 |
| 2,242,166 | 5/1941 | Bennett | 103/1 |
| 3,740,801 | 6/1973 | Sears et al. | 285/137.1 X |
| 4,042,023 | 8/1977 | Fox | 166/241.7 |
| 4,306,620 | 12/1981 | Fronius | 166/241.6 |
| 4,337,969 | 7/1982 | Escaron | 285/119 X |

FOREIGN PATENT DOCUMENTS

| | | |
|---|---|---|
| 0480501A | 4/1992 | European Pat. Off. . |
| 448662 | 8/1927 | Germany . |
| 2545595 | 4/1977 | Germany . |

OTHER PUBLICATIONS

Pp. 80–83 of a book entitled: "*Unterwasserpumpen*" (Excerpt of Technische Bücher der Klein, Schanzlin & Becker AG Book No. 1258).

*Primary Examiner*—Arola: Dave W.
*Attorney, Agent, or Firm*—Cohen, Pontani, Lieberman, Pavane

[57] ABSTRACT

A pipeline with threaded pipes and a sleeve connecting the pipes which is hung in a drill hole for transporting a liquid and/or gaseous medium. An electrically driven pump or compressor is arranged at the start of the pipeline in the region of the base of the drill hole and the electric motor is supplied with electric power via a cable hung in the drill hole. In order to allow for large cable cross sections for the electric drive of a turbopump or a turbocompressor and to prevent impermissible loading of the cable, each sleeve of the pipeline has at least one groove extending in the longitudinal direction at its outer casing, the cable being guided in this groove.

12 Claims, 3 Drawing Sheets

PIPELINE WITH THREADED PIPES AND A SLEEVE CONNECTING THE SAME

BACKGROUND OF THE INVENTION

1. Field of the Invention

The invention is directed to a pipeline with threaded pipes and a sleeve connecting the same, which is hung in a drill hole for transporting a liquid and/or a gaseous medium. An electrically driven pump or compressor is arranged at the front of the pipeline near the base of the drill hole and electricity is supplied to the motor of the pump/compressor by a cable hung in the drill hole.

2. Description of the Prior Art

In transporting crude oil or natural gas or mixtures of the two, it is conventional and known to arrange a turbopump or a turbocompressor at the start of a transporting pipeline in the region of the drilling base when the bearing pressure is too weak or for the purpose of increasing the transported quantity (EP 0480501). This turbopump or turbocompressor can be driven hydraulically by means of supplied liquid or electrically. When an electric motor is used as the drive means, the electric power must be fed to the electric motor via a cable. The clear cross section of the transporting pipe offers an obvious possibility for hanging the cable, especially since the axis of the turbodevice is aligned with the axis of the transporting pipeline. Nevertheless, because of the anticipated abrasion, for example, the cable is hung for technical reasons relating to safety and flow properties in such a way that it is situated in the annular space between the concentrically arranged transporting pipeline and the pipeline casing or liner. This annular space, which is already narrow in modern slim-hole drill holes which are becoming increasingly common, is extremely constricted in the region of the connecting sleeves, so that it is not possible to realize the desired large cable cross section and low power losses. Moreover, there is naturally a much higher risk in the narrow region of the connections that the cable will be damaged by contacting or knocking against the inner wall of the pipe liner. Since the drill holes have a depth of at least several hundred meters, generally more than 2000 m, there is a risk of fouling, and thus highly loading, the cable when installing the pipeline. In unfavorable cases the cable can even tear or the insulation can be damaged.

SUMMARY OF THE INVENTION

The object of the present invention is to provide a pipeline of the generic type having threaded pipes and a sleeve connecting these threaded pipes in which large cable cross sections for the electric drive of a turbopump or turbocompressor are made possible and impermissible loading of the cable is prevented.

This object is met by a sleeve having at least one groove extending in the longitudinal direction at its outer surface area or outer casing. The electric cable is pressed into and fixed in this groove, and the pipeline is then lowered.

Since it cannot be expected that the groove of every sleeve of the pipeline will be aligned with the groove of the sleeve arranged above it or below it when screwed together, in a further embodiment of the invention the outer casing has three grooves which are offset by 120°. This means that, in the worst of cases, the cable will be turned by a maximum of 60° relative to the preceding sleeve, i.e. the bending angle of the cable can be kept under 1°. This variable can be reduced even more by providing additional grooves, but this would increase the cost of producing the grooves and would weaken the cross section of the sleeve proportionately. Of course, this weakening could be compensated for by enlarging the cross section, but only at the expense of the space requirement of the annular gap between the transporting pipe and pipe liner.

For extreme cases when the available gap between the transporting pipe and pipe liner, in particular in the region of the sleeve, is 7 mm or less, for example, as is the case in slim-hole drill holes which are becoming increasingly common for economical reasons, a special cross-sectional outer contour of the sleeve is suggested. The outer contour can be expressed mathematically by the following trigonometric function:

$$r(\phi)\ \frac{Rmax + Rmin}{2} + \frac{Rmax - Rmin}{2}\ (\sin 3\phi),$$

where the origin of the polar coordinate system lies in the center of the circular inner contour of the sleeve and Rmax represents the greatest distance between the outer contour of the sleeve and the axis of the sleeve. Rmin is the smallest distance between the outer contour of the sleeve and the axis of the sleeve.

It follows that the values of opposite radii add up to a constant value—corresponding to the sum of the greatest and smallest radius—and that the consecutive radii of a circle sector of 60° change from the greatest to the smallest radii and from the smallest to the greatest radius in the next 60-degree sector. This change in radius repeats three times along the full circumference.

Another shape corresponds to a truncated epicycloid with three branches (Bronstein-Semendjajew, fourth edition, B. G. Teubner Verlagsgesellschaft, Leipzig 1961, chapter 11, pages 88 to 92). This special epicycloid with three branches is generated by a point lying within a circle which rolls on the outside of a fixed circle. The ratio of the diameter of the rolling circle to the fixed circle is 1:3. In order to fulfill the condition that every diametrical section of this special cross-sectional contour always has the same or approximately the same rolling circle to the fixed circle is 1:3. In order to fulfill the condition that every diametrical section of this special cross-sectional contour always has the same or approximately the same diameter, the adjacent curve portions at the transition from one branch to the next branch must form a common tangent. This can be achieved in that the describing point lies in the vicinity of the center of the rolling circle. The cross-sectional contour described above has the great advantage that, given a constant diameter for each diametrical section, three maxima are formed in which a groove can be arranged for the guidance of the cable. Accordingly, less space is required than in a circular cross-sectional contour of the same magnitude. The advantage of arranging three grooves is that the maximum twisting or turning angle for the cable relative to the next sleeve is 60° and when a three-phase drive is used three cables, one for each phase, can be hung simultaneously.

For conventional cables with a round cross section it is suggested that the transition between the base of the groove and the side walls be rounded so that the base of the groove forms a semicircle. When flat cable is required due to space requirements, this rounded portion can be oval, elliptical or circular. A rounding off of this kind allows the cable to conform neatly to the base of the groove and the cable will also not be loaded or damaged due to relative movements between the cable and groove base.

To prevent the cable from jumping out of the groove, in a further embodiment the open area is covered by means of a strip. This strip can be produced from plastic or light metal, for example, and has contoured webs at the sides so that the strip can be clipped in. An additional advantage of this covering is that the outside of the cable is not rubbed off or damaged in the particularly narrow gap between the outer casing of the sleeve and the inside of the pipe liner when the pipeline is let down.

Moreover, the grooves can be used for a positive locking transmission of torque when screwing together the connections. This avoids the radial compression in the connection area brought about by a frictionally locking transmission with the use of conventional screw pliers that can lead to permanent deformations due to the thinness of the sleeve wall of slim-hole sleeves and can thus damage the connection during the screwing process. The screw pliers must be outfitted with appropriate jaws and jaw guides for this purpose.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
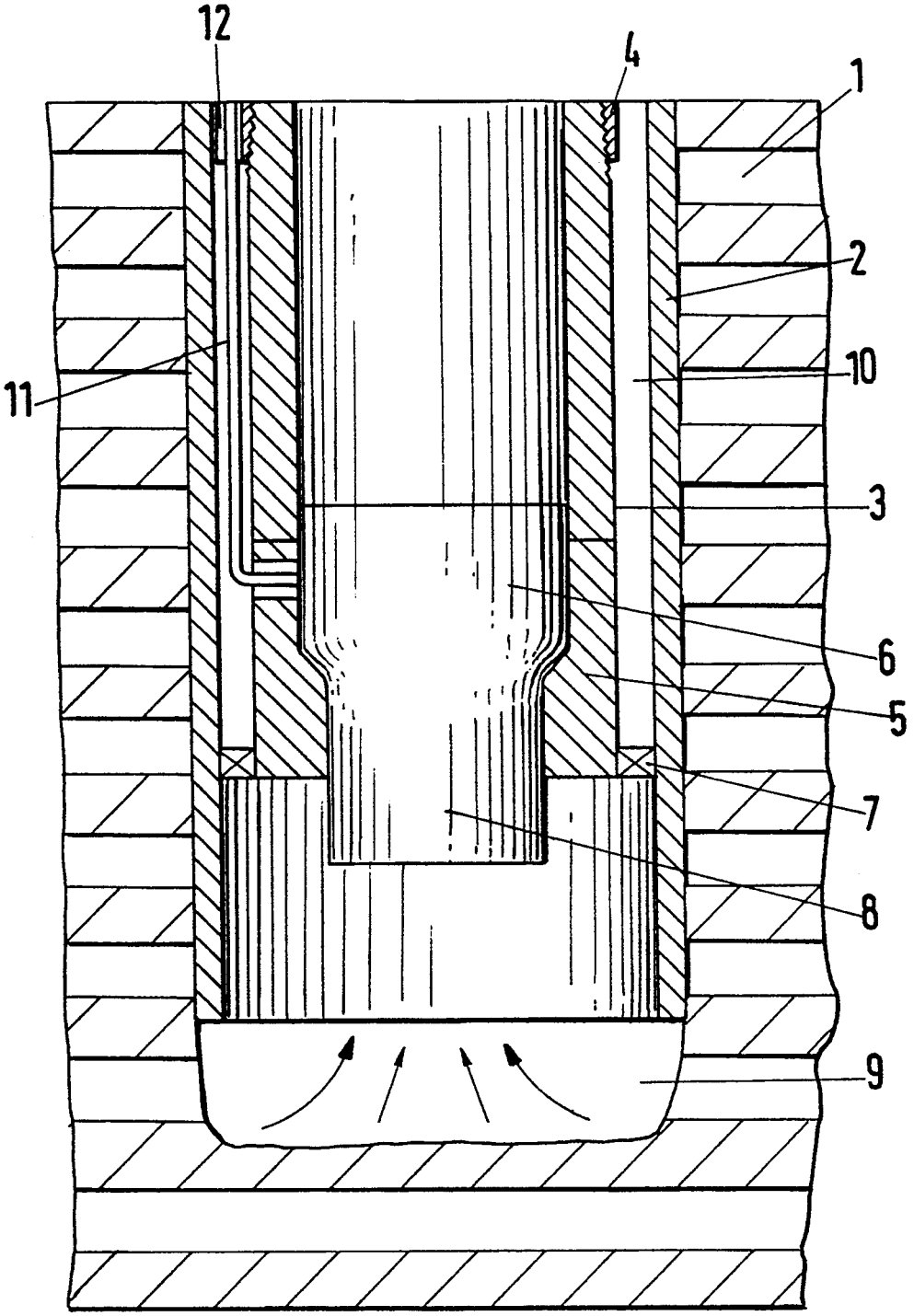
FIG. 1 shows a section through a portion of a pipeline according to the invention.

FIG. 1 shows a section of a pipeline according to the invention. A pipe liner 2 within which the transporting pipeline is hung supports the drill hole against the surrounding earth 1. The section shown in the drawing shows a transporting pipe 3 which is connected by means of a sleeve 4 with the next transporting pipe, not shown in the drawing, arranged above it. The turbopump 6, which is only indicated schematically, is arranged in an adaptor piece 5 connected at one end with the transporting pipe 3. The annular gap 10 between the transporting pipe 3 and the pipe liner 2 is sealed with a packing element 7. The suction pipe 8 of the turbopump 6 projects into the region of the drill hole base 9. The liquid and/or gaseous medium flows into the suction pipe 8 due to the slight vacuum generated in the turbopump 6.

In the construction shown in the drawing, the turbopump 6 is driven by an electric motor, not shown. The electric power is supplied via a cable 11 which is hung in the annular gap 10. The cable 11 is guided in the region of the sleeve 4 in a groove 12 arranged at the outer casing of the sleeve. This upward guidance of the cable continues through the sleeves arranged above it in the pipeline, which sleeves are likewise provided with a groove. All sleeves preferably have three grooves 12, 12', 12'' which are arranged so as to be offset by 120°. In order to achieve the largest possible total cross section of the cable, three cables 11 can be guided simultaneously, i.e. each of them in one of the three grooves 12, 12', 12''. When using three-phase current, it is especially advantageous to guide a current phase in each groove 12, 12', 12'', since the cable 11 in question would then only require outer insulation and the conductor cross section would not be reduced by the additional insulation of the phases which would otherwise be required. When three grooves 12, 12', 12'' are provided, the twisting angle of the cable 11 from the sleeve 4 to the next sleeve is a maximum of 60°.

Figure 2:
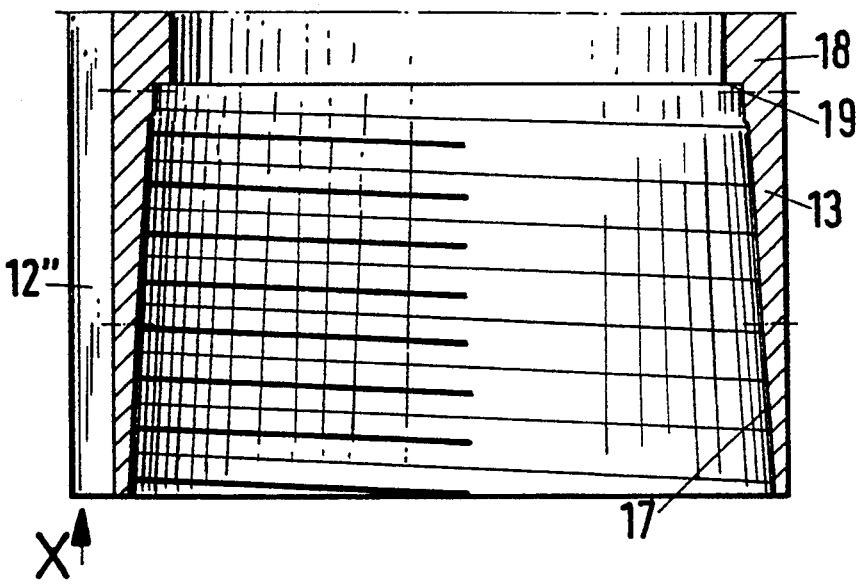
FIG. 2 shows a half-cross section along line A—A in FIG. 3 of a special embodiment of the invention.
Figure 3:
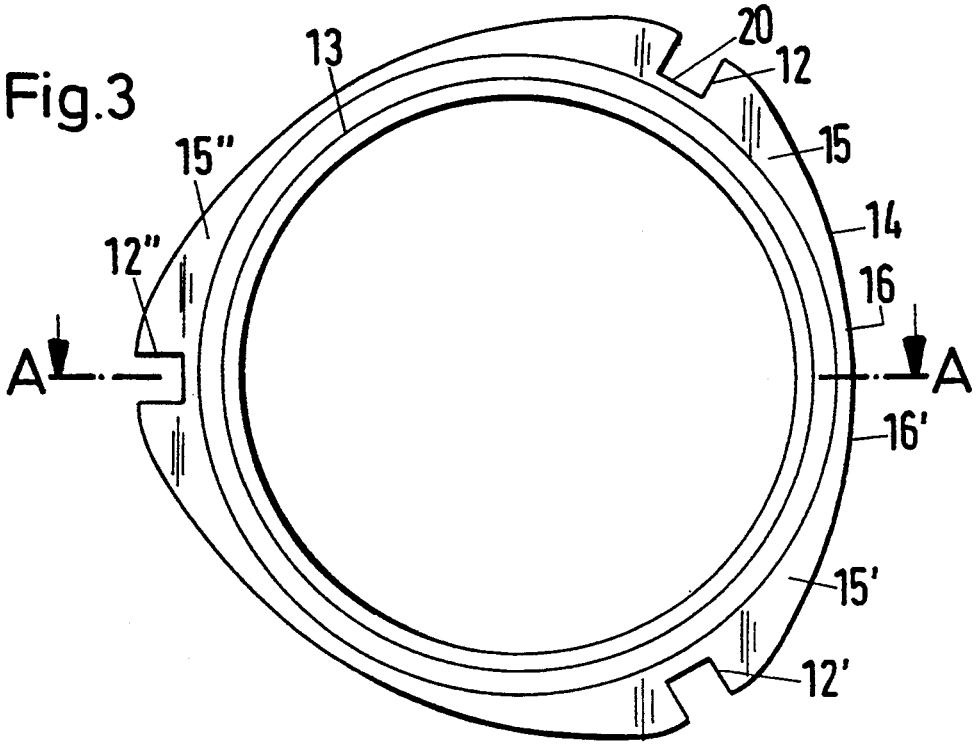
FIG. 3 shows a view in direction X in FIG. 2.

A special embodiment of a sleeve 13 provided with grooves 12, 12', 12'' is shown in section in FIG. 2 and in a top view in FIG. 3. In an extreme case of an annular gap 10 between the transporting pipe 3 and the pipe liner 2, particularly in the region of the sleeve 4, a sleeve 3 with a cross-sectional contour 14 shown in FIG. 3 is used. This cross-sectional contour 14 corresponds geometrically to a truncated epicycloid with three branches. This contour 14 has three maxima in which the grooves 12, 12', 12'' are arranged. In the transitional area between one branch 15 and the next branch 15', the two adjacent curve portions 16, 16' have a common tangent. Accordingly, each diametrical section has the same diameter.

The section in FIG. 2 shown along line A—A in FIG. 3, shows that the sleeve thread 17 in this embodiment is conical and the sleeve 13 in the threadless portion 18 has a butt shoulder 19 with a 15-degree slope. Clearly, the manner in which the thread is constructed has no bearing on the guidance, according to the invention, of an electric cable 11 by means of the grooves 12, 12', 12'' arranged at the outer casing. For example, the sleeve could have a cylindrical thread. The degree to which the maximum bulges out is determined by the diameter of the cable 11 to be guided, since there must remain sufficient wall material for the sleeve 13 after the grooves 12, 12', 12'' have been arranged. In view of the notch effect of the grooves 12, 12', 12'', it is advantageous to round off the transition between the groove base 20 and the side walls.

Figure 4:
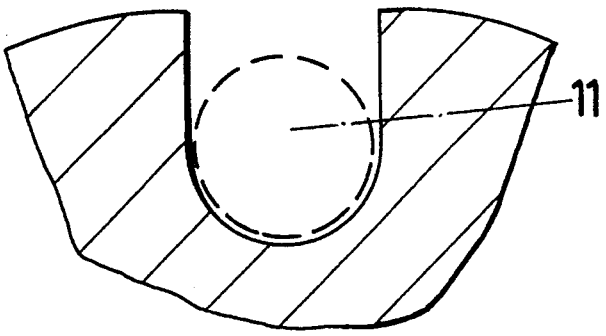
FIG. 4 shows a rounded groove shape in enlarged scale.
Figure 5:
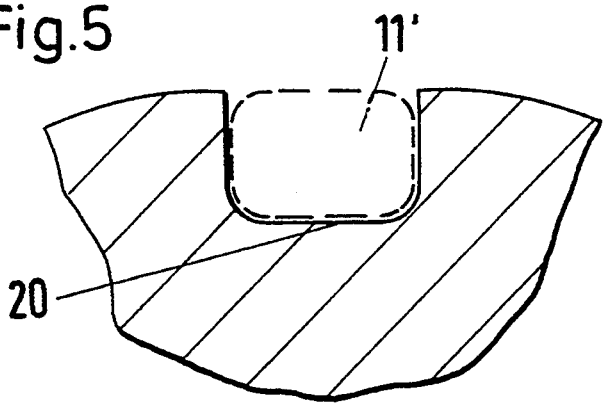
FIG. 5 is a view identical to that in FIG. 4, but with a different groove shape.

Variants of rounded off constructions are shown in FIGS. 4 and 5 in enlarged scale. It can be seen from the cable 11, 11' shown in dashes that its conformity to the base is improved in comparison to a rectangular groove 12.

Figure 6:
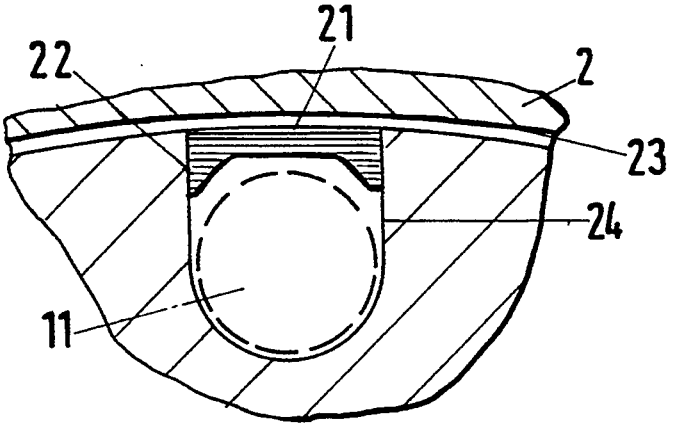
FIG. 6 is a view identical to that in FIG. 5, but with a cover.

FIG. 6 shows the cover of the open region of a groove 24, likewise in enlarged scale. This cover is a strip 21 having contoured webs 22 at the sides so that the strip can be snapped in. This protects the cable 11 from abrasion and damage against the inner wall 23 of the pipe liner 2 when the pipeline is installed.

The invention is not limited by the embodiments described above which are presented as examples only but can be modified in various ways within the scope of protection defined by the appended patent claims.

I claim:

1. A pipeline which is hung in a drill hole for transporting a fluid medium, comprising: a plurality of threaded pipes; and a plurality of internally threaded sleeves, each of the sleeves connecting together two of the pipes end to end, the sleeves each having an outer casing with three grooves offset by 120° and extending in a longitudinal direction of the pipeline in which a cable can be guided.

2. A pipeline according to claim 1, wherein the outer casing has a cross-sectional contour that corresponds to a truncated epicycloid with three branches, the grooves being integrally arranged in a maximum region of the cross-sectional contour.

3. A pipeline according to claim 2, wherein the contour has diametrical sections with diameters that are at least approximately identical.

4. A pipeline according to claim 1, wherein the outer casing has a cross-sectional contour that corresponds to a truncated epicycloid with three branches, one groove being integrally arranged in a maximum region of each of the branches of cross-sectional contour.

5. A pipeline according to claim 1, wherein the sleeve has an axis, the outer casing has a cross-sectional contour that corresponds to the following trigonometric function:

$$r(\phi)\frac{Rmax + Rmin}{2} + \frac{Rmax - Rmin}{2}(\sin 3\phi),$$

where

Rmax = a greatest distance between the outer contour of the sleeve and the axis of the sleeve, Rmin = a smallest distance between the outer contour of the sleeve and the axis of the sleeve, $\phi$ contour angle, values of opposite radii add up to a constant value corresponding to a sum of the greatest and smallest radius, changes in the radii from the greatest to the smallest value repeat three times along the contour circumference, the grooves being arranged in a respective maximum region of the cross-sectional contour.

6. A pipeline according to claim 5, wherein the contour has diametrical sections with diameters that are at least approximately identical.

7. A pipeline according to claim 1, wherein each groove has a base, side walls and a transition between the groove base and the side walls that is rounded.

8. A pipeline according to claim 1, and further comprising a cable with a three-phase current guided in at least one of the grooves.

9. A pipeline according to claim 1, and further comprising a cover strip that can be snapped in each of the grooves so as to cover an open region of each groove.

10. A pipeline according to claim 9, wherein the cover strip has sides with contoured webs that engage side walls of each groove.

11. A pipeline according to claim 9, wherein the cover strip is made of plastic.

12. A pipeline according to claim 1, and further comprising an adaptor piece connected at a free end of a front-most of the threaded pipes; an electric pump connected to the adaptor piece; a suction pipe connected to the pump; and a cable connected to the pump and arranged in the grooves of the sleeves so as to permit a supply of electricity to the pump.

* * * * *